United States Patent [19]

Albrecht

[11] 3,986,068

[45] Oct. 12, 1976

[54] MINIATURE INDICATING LAMP

[75] Inventor: Paul Albrecht, Bamberg, Germany

[73] Assignee: W. Albrecht KG, Bamberg, Germany

[22] Filed: Apr. 28, 1975

[21] Appl. No.: 572,442

[30] Foreign Application Priority Data

Dec. 10, 1974 Germany ..... 2458296

[52] U.S. Cl. ..... 313/318; 313/315; 339/144 T; 339/145 T

[51] Int. Cl.[2] ..... H01J 5/48; H01J 5/50

[58] Field of Search ..... 313/318, 315; 339/144 R, 145 R, 144, 145

[56] References Cited

UNITED STATES PATENTS

| | | | |
|---|---|---|---|
| 2,053,138 | 9/1936 | Donovan | 313/318 X |
| 3,286,088 | 11/1966 | Ahroni | 313/318 |
| 3,286,219 | 11/1966 | Herrick | 313/318 X |
| 3,541,381 | 11/1970 | Matsuya | 313/318 |
| 3,619,702 | 11/1971 | Albrecht | 313/318 |
| 3,800,377 | 4/1974 | Palmen | 313/318 |

*Primary Examiner*—Saxfield Chatmon, Jr.
*Attorney, Agent, or Firm*—Haseltine, Lake & Waters

[57] ABSTRACT

A miniature indicating lamp with a base made of synthetic material for insertion into a socket. The lamp is provided with an upper hollow-cylindrical glass portion, and a base which has a bottom portion in the form of a flat plug. A separating wall extends parallel to the axis of the lamp and has bores on both sides of the wall. Connecting wires are inserted in the bores and extend into the upper hollow-cylindrical glass portions. The bores and connecting wires are substantially at the center of the bottom portion of the base, and grooves communicating with the bores, provides access to them.

4 Claims, 5 Drawing Figures

MINIATURE INDICATING LAMP

BACKGROUND OF THE INVENTION

The so called "glass-base lamps" are widely used in the art as miniature indicating lamps, with the glass base usually formed by a squeezing operation into a flat plug. Their advantage is that without additional base material and without installation effort, and in connection with suitable sockets an easily interchangeable inexpensive lamp can be created. The disadvantage, in addition to the sensitivity to breakage, especially with the smallest lamp types, is the low adherence to tolerances of the glass base, and the resulting poor fit in the socket.

To avoid these disadvantages, a miniature indicating lamp of the above-mentioned type with a synthetic material base is already known in the art. Connecting wires are pulled through the base part (which has the shape of a flat plug) at the bottom side, and advantageously connected at the bottom side with contact laminations making contact, which are attached to the base on both sides of the protruding axis parallel to the separating wall.

This design for miniature indicating lamps has been extremely successful in practical application and makes possible the manufacture of very small incandescent lamps at economical cost.

It is, therefore, an object of the present invention to provide miniature indicating lamps with a synthetic base in such a way that they permit even further reduced dimensions with much simplified and inexpensive manufacture, retaining the advantages of the known or conventional form of construction.

Another object of the present invention is to provide a miniature indicator lamp which is reliable in operation and has a substantially long operating life.

Therefore the object of the present invention is to provide an indicating lamp in which the component parts may be readily assembled.

SUMMARY OF THE INVENTION

The objects of the present invention are achieved by providing, a miniature indicating lamp of the initially mentioned type according to the present invention, with grooves in the center of the base part to give access to the connecting wires on one side.

The embodiment of the present invention, in conjunction with a socket with contact springs engaging the grooves and pressing against a plane inside surface of the socket, makes possible or (facilitates) the simultaneous mechanically centered mounting of the base in the socket with electrical contact provided by the contact springs. Compared to the above-described known forms, manufacturing effort is considerably simplified, since on the synthetic base, only the grooves are required to provide access to the drill holes with the connecting wires. Evidently these grooves can be produced even with very small types in a most simple fashion with sufficient accuracy of fit.

While, for example, with the "all glass" method, lamps with a length of less than approx. 20 mm cannot be produced,, lamps of the present invention can be produced with much smaller length, and also with greatly reduced diameters, they can be manufactured inexpensively and with accurate fit.

The novel features which are considered as characteristic for the invention as set forth in particular in the dependent claims. The invention itself, however, both as to its construction and its method of operation, together with additional objects and advantages, thereof, will be best understood from the following description of specific embodiments when read in connection with the accompanying drawings.

DESCRIPTION OF THE PREFERRED EMBODIMENTS

Figure 1:
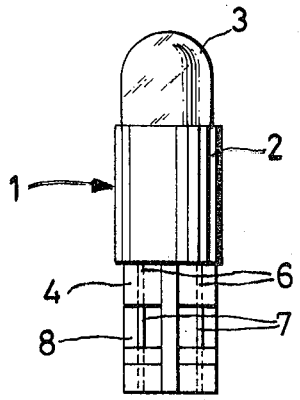
FIG. 1 is a side view of a miniature indicating lamp.
Figure 2:
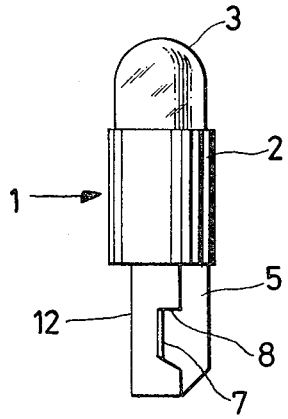
FIG. 2 is a view of the indicating lamp of FIG. 1, when rotated by 90°.

Referring to FIG. 1, the upper part of the synthetic material base of the miniature indicating lamp 1 comprises a cylindrical sleeve 2 for receiving the baseless glass bulb of a miniature incandescent lamp 3. Base part 4 which has the form of a flat plug is provided with a separating wall 5 parallel to the longitudinal axis of the lamp. The separating wall protrudes beyond it on one side, and has drill holes 6 parallel to the longitudinal lamp axis and located on both sides of this separating wall, to accommodate the connecting wires 7 of the lamp. These drill holes 6 are accessible on one side through grooves 8 provided in the middle of base part 4, together with the connecting wires 7.

Figure 3:
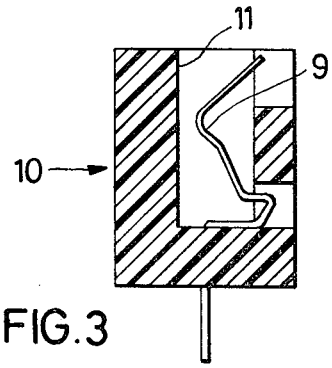
FIGS. 3 and 4 are longitudinal sections and top views of a lamp socket for receiving the indicating lamp of FIGS. 1 and 2.
Figure 4:
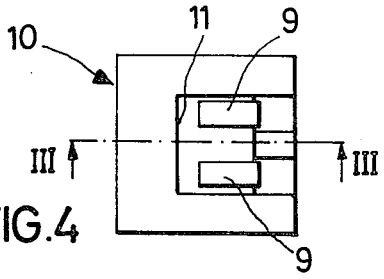
Figure 5:
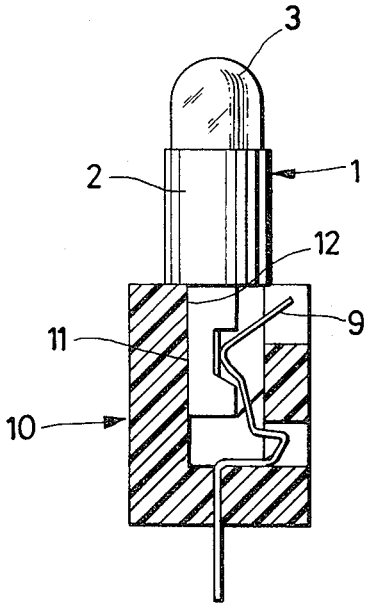
FIG. 5 is a longitudinal section taken through the socket with the indicating lamp inserted, in accordance with the present invention.

By engaging a contact spring 9, preferably a leaf spring, of the associated socket 10 (FIGS. 3 through 5) the miniature indicating lamp can be contacted electrically and centered mechanically in the socket. That side of base part 4 which has no separating wall and has a flat side 12, is pushed by the contact springs against an associated surface 11 of the socket. In conjunction with the suitable design of both grooves 8 and of contacct springs 9, an exact positioning of the lamp in the socket is assured also radially. The separating wall 5 is used both for mechanical and electrical separation of the connecting wires 7 and of contact springs 9. Deviating from the embodiment shown, a suitable groove may also be provided in the associated side wall of the socket for additional centering and to further increase the resistance to leakage current and the dielectric strength.

In addition to the above-mentioned advantages, another advantage of the subject invention is the possibility of polarizing the contacts. Thus, the socket can also be used for components (e.g., diodes) where noninterchangeable polarity is required. Beyond that, it provides an immovable positioning of the connecting wires by guiding them through the drill holes 6 ahead of and behind the contact area in grooves 8.

The current lead-in wires 7 may be located in their entirety inside drill holes 6 or protrude beyond the bottom side of the base part. In this manner it facilitates use in conjunction with bases of different design. In addition, in the latter case where the connecting wires protrude outside the base part, by soldering or welding in this area, an additional fixing of the lamp body can be achieved in the cylindrical sleeve of the base. This is in addition to or in place of the locking action (for example by means of internal centering ribs), or their cementing or gluing.

Without further analysis, the foregoing will reveal the gist of the present invention that others can, by applying current knowledge, readily adopted for various applications without omitting features that, from the standpoint of prior art, fairly constitues essential characteristics of the generic or specific aspects of this invention, and therefore, such adoptations should be intended to be comprehended within the meaning and range of equivalence the following claims.

I claim:

1. A miniature indicating lamp for insertion into a socket comprising, in combination, a upper hollow-cylindrical glass portion; a base of synthetic materials; a bottom portion on said base in a form of a flat plug; a separating wall parallel to the axis of said lamp the bottom portion of said base having bores connecting wires in said bores and extending into said upper hollow cylindrical glass portion, said bores and connecting wires being substantially at the center of said bottom portion of said base; and groove means communicating with said bores for providing access thereto, the connecting wires inserted from said lamp into said bores of said base portion being bare and contacted directly by said grooves, said connecting wires being free of insulation and being free of contacting bent-back sections.

2. A miniature indicating lamp as defined in claim 1 including socket means for receiving said indicating lamp; contact spring means engaging said groove means and pressing said bottom portion a planar interior surface in said socket means.

3. A miniature indicating lamp as defined in claim 2 wherein said groove means and said contact spring means are shaped for centrally mounting said base in said socket means.

4. The miniature indicating lamp as defined in claim 3 wherein said contact spring means comprises contact springs having a subtantially wave-shape along the length thereof.

* * * * *